US009259753B2

(12) United States Patent
Ataka

(10) Patent No.: US 9,259,753 B2
(45) Date of Patent: Feb. 16, 2016

(54) FLOW CHANNEL MEMBER, LIQUID EJECTING HEAD, AND LIQUID EJECTING APPARATUS

(71) Applicant: Seiko Epson Corporation, Tokyo (JP)

(72) Inventor: Miyuki Ataka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 471 days.

(21) Appl. No.: 13/689,072

(22) Filed: Nov. 29, 2012

(65) Prior Publication Data

US 2013/0146681 A1 Jun. 13, 2013

(30) Foreign Application Priority Data

Dec. 13, 2011 (JP) ..... 2011-272128

(51) Int. Cl.
*B05B 15/00* (2006.01)
*F17D 1/00* (2006.01)
*B41J 2/14* (2006.01)

(52) U.S. Cl.
CPC ..... *B05B 15/00* (2013.01); *B41J 2/14274* (2013.01); *F17D 1/00* (2013.01); *Y10T 137/3084* (2015.04)

(58) Field of Classification Search
CPC B05B 17/06; B05B 17/0638; B05B 17/0653; B05B 17/0676; B05B 15/00; F17D 1/00; Y10T 137/3084; Y10T 137/3003; Y10T 137/2931; B41J 2/135; B41J 2/14201; B41J 2/14274
USPC ..... 239/102.2, 569, 575
See application file for complete search history.

(56) References Cited

U.S. PATENT DOCUMENTS 4,512,955 A * 4/1985 Etani ..... 422/266

FOREIGN PATENT DOCUMENTS

JP 2006095878 A 4/2006
JP 2008-213314 A 9/2008

* cited by examiner

*Primary Examiner* — Christopher Kim

(57) ABSTRACT

A flow channel member includes: an ink flow channel having a horizontal flow channel; a self-sealing valve disposed on the downstream side of the ink flow channel and configured to open and close the ink flow channel; a pressurizing unit configured to apply a pressurizing force to the ink in the ink flow channel from the upstream side; and an air bubble trap provided in the middle of the horizontal flow channel for storing an air bubble, wherein the air bubble trap includes an air-bubble permeable wall formed of an air-bubble permeable member configured to allow permeation of the air bubble and is configured to cause the air bubble coming into abutment with the air-bubble permeable wall to be a flat shape and to be pressed against the air-bubble permeable wall so as to bring the air bubble into surface contact with the air-bubble permeable wall.

12 Claims, 5 Drawing Sheets

FLOW CHANNEL MEMBER, LIQUID EJECTING HEAD, AND LIQUID EJECTING APPARATUS

CROSS REFERENCE TO RELATED APPLICATION(S)

The entire disclosure of Japanese Patent Application No.: 2011-272128, filed Dec. 13, 2011 is incorporated by reference herein.

BACKGROUND

1. Technical Field

The present invention relates to a flow channel member, a liquid ejecting head, and a liquid ejecting apparatus and, more specifically, to a flow channel member provided with a flow channel in the interior thereof, a liquid ejecting head, and a liquid ejecting apparatus.

2. Related Art

As a representative example of a liquid ejecting head configured to eject liquid droplets, an ink jet recording head configured to eject ink droplets is exemplified. For example, an ink jet recording head including head bodies (head bodies each including a head case, a flow channel unit, and an oscillator unit) configured to eject ink droplets from nozzle openings, and a common flow channel member configured to supply ink from ink cartridges as ink supply sources fixed to the head bodies and including ink stored therein to the respective head bodies is proposed.

According to the ink jet recording head configured as described above, ink in the ink cartridge is supplied to the head body via an ink flow channel of the flow channel member. The flow channel member includes an air bubble trap configured to store air bubbles contained in ink and a filter provided on the downstream side of the air bubble trap, and a problem of clogging of the filter with the air bubbles, which may reduce the effective area of the filter, is restrained by trapping the air bubbles by the air trap.

However, since the air bubbles in the ink flow channel are gradually grown and are increased in size, the air bubbles which are excessively grown need to be regularly removed.

Accordingly, in the ink jet recording head of this type, a cleaning operation which generates an ink flow having a velocity several times higher than the velocity at the time of a printing operation is regularly performed to discharge air bubbles in the ink flow channel. In contrast, as a configuration which is capable of discharging air bubbles mixed into ink by a method other than the cleaning operation, there is proposed a configuration including a gas-permeable film provided on a side surface of a common liquid chamber which communicates with a pressure chamber of a head body, and a chamber provided on the side of the gas-permeable film opposite from the side which comes into contact with ink, in which generation of air bubbles in the pressure chamber is restrained by generating a negative pressure in the chamber to deaerate the ink in the common liquid chamber (JP-A-2006-95878).

However, with the configuration described in JP-A-2006-95878, since the deaeration is not achieved by allowing permeation of the air bubbles in the common liquid chamber through the gas-permeable film unless a large pressure difference is set between the interior of the common liquid chamber and the chamber, a large scale of a depressurizing unit is required for obtaining a sufficient deaeration capability. In addition, if the pressure difference is too large, the ink loses moisture mixed and hence the viscosity of the ink in the ink flow channel is increased. Therefore, control of the pressure in the chamber while monitoring by using a pressure gauge or the like is required. There is also a problem that the gas-permeable film formed of a fluorinated thin film or a silicon-based thin film is reduced in transmissivity if the ink bleeds. Furthermore, when the deaeration is not achieved sufficiently in the common liquid chamber and if the air bubbles is mixed in the ink flow channel inadvertently due to loading or unloading of the ink cartridge, and the air bubbles may enter the adjacent pressure chamber before being blended in the ink, which may cause a problem.

Such problems exist not only in the ink jet recording head, but also in the liquid ejecting head which ejects liquid other than ink, and also in the flow channel member used for other applications other than the liquid ejecting head.

SUMMARY

An advantage of some aspects of the invention is that a flow channel member, a liquid ejecting head, and a liquid ejecting apparatus which allow a reduction of number of times of cleaning operation as much as possible, and are capable of discharging air bubbles mixed in a liquid flow channel of the flow channel member to prevent occurrence of problems caused by the entry of the air bubbles in advance in a simple configuration are provided.

According to a first aspect of the invention, there is provided a flow channel member including: a liquid flow channel having in at least part thereof a horizontal flow channel configured to cause liquid supplied from a liquid supply source in the horizontal direction; a valve disposed on the downstream side of the liquid flow channel and configured to open and close the liquid flow channel; a pressurizing unit configured to apply a pressurizing force to the liquid in the liquid flow channel from the upstream side; and an air bubble trap provided in the middle of the horizontal flow channel for storing an air bubble, wherein the air bubble trap includes an air-bubble permeable wall formed of an air-bubble permeable member configured to allow permeation of the air bubble therethrough in at least a ceiling portion thereof and is configured to cause the air bubble coming into abutment with the air-bubble permeable wall to be a flat shape and to be pressed against the air-bubble permeable wall so as to bring the air bubble into surface contact with the air-bubble permeable wall.

In this configuration, since the ceiling portion of the air bubble trap is formed of the air-bubble permeable wall and, in addition, the air bubble trapped by the air bubble trap is pressed by the air-bubble permeable wall and hence has a flat shape, the contact surface area between the air bubble and the air-bubble permeable wall may be increased. Consequently, the air bubble in the air bubble trap is discharged to the outside via the air-bubble permeable wall, and the growth of the air bubble in the air bubble trap is restrained correspondingly. In this manner, an interval of cleaning, which is air-bubble maintenance, is elongated, and wasteful consumption of liquid in association with the cleaning may be reduced as much as possible.

Preferably, a filter is disposed between the air bubble trap and the valve so as to traverse the liquid flow channel. Since the growth of the air bubble may be restrained, reduction of the effective area of the liquid flow channel may be effectively prevented by contact between the air bubble and the filter.

Preferably, an air bubble discharge chamber as a space adjacent to the air-bubble permeable wall is provided, and the air bubble discharge chamber is configured so as to be capable of opening to the atmosphere. In this case, it is because the permeation of the air bubble via the air-bubble permeable wall may be encouraged by bringing the air-bubble discharge chamber into a negative pressure. It is further preferable that the air-bubble permeable wall is formed with depressions and projections on a surface on the side of the air bubble trap. It is because the contact surface between the air-bubble permeable wall and the air bubble may be increased, and the permeation efficiency of the air bubble may be improved correspondingly.

A second aspect of the invention is a liquid ejecting head including: a head body having a nozzle opening configured to eject liquid; and a flow channel member having a liquid flow channel communicating with the nozzle opening, wherein the flow channel member is formed of the flow channel member described above.

In this configuration, since an air bubble self-discharging function of the flow channel member comes into play, the interval of the cleaning of the liquid ejecting head may be elongated.

A third aspect of the invention is a liquid ejecting apparatus including the liquid ejecting head described above.

In this configuration, since the interval of the cleaning of the liquid ejecting head may be elongated, the efficiency of operation of the liquid ejecting apparatus may be improved.

BRIEF DESCRIPTION OF THE DRAWINGS

The invention will be described below with reference to the accompanying drawings, wherein like numbers reference like elements.

DESCRIPTION OF EXEMPLARY EMBODIMENTS

The invention will be described in detail on the basis of embodiments.

Figure 1:
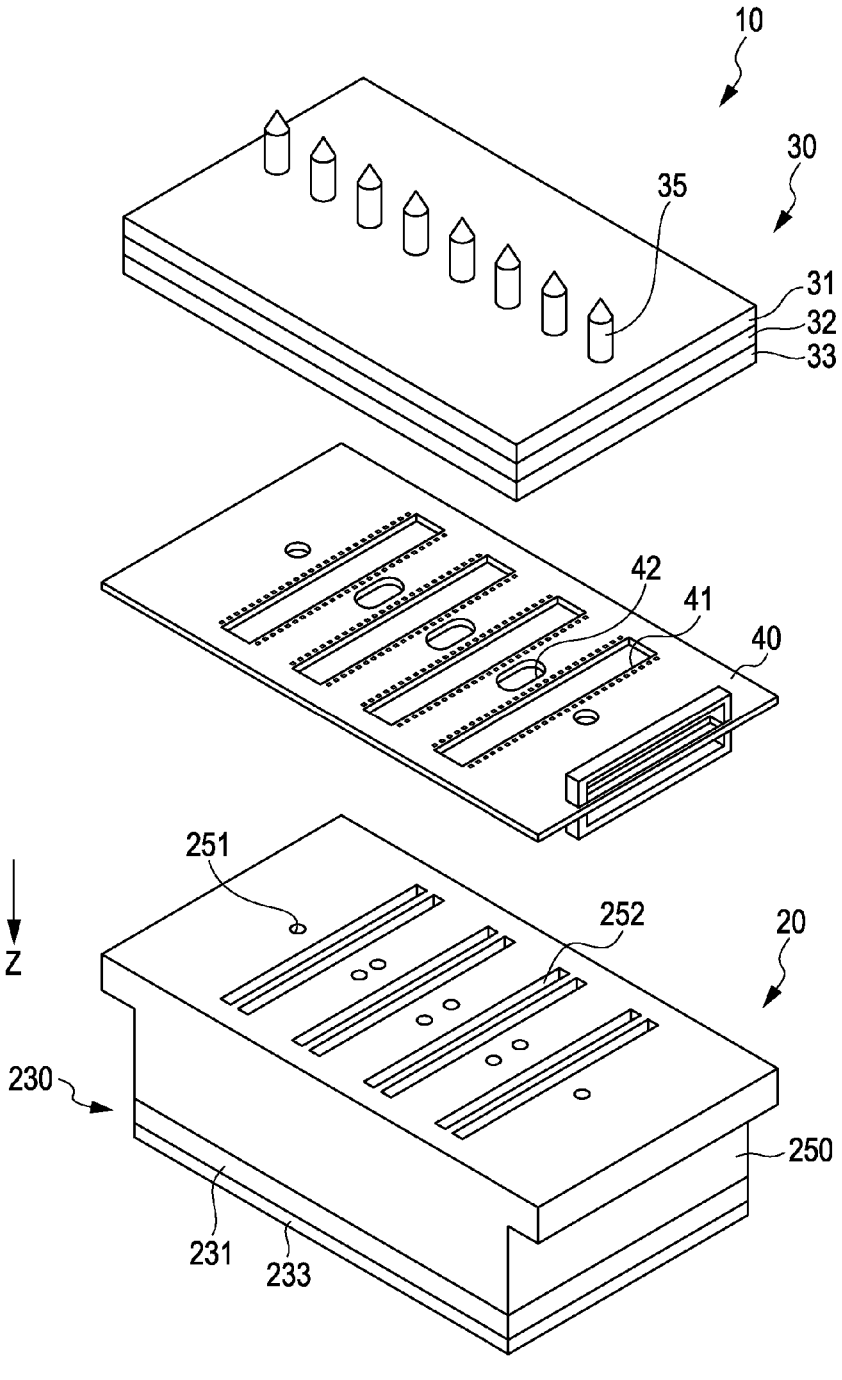
FIG. 1 is an exploded perspective view of a recording head according to the embodiment of the invention.

FIG. 1 is an exploded perspective view of an ink jet recording head as an example of the liquid ejecting head according to an embodiment of the invention.

As illustrated in FIG. 1, a ink jet recording head 10 according to the embodiment includes a head body 20 capable of ejecting ink droplets as liquid, a flow channel member 30 configured to supply ink to the head body 20, and a wiring substrate 40 held between the head body 20 and the flow channel member 30.

Figure 2A:
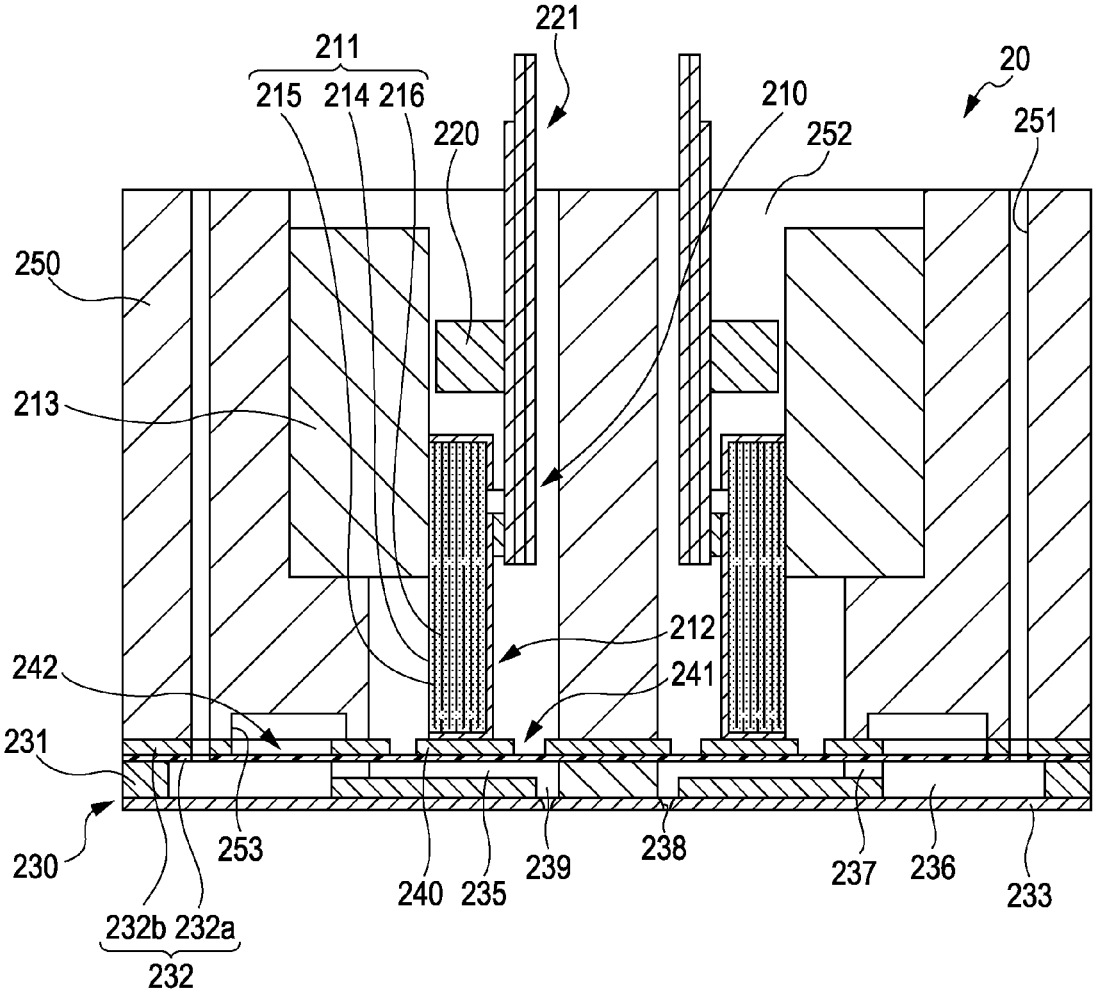
FIGS. 2A and 2B are cross-sectional views of a head body according to an embodiment of the invention.
Figure 2B:
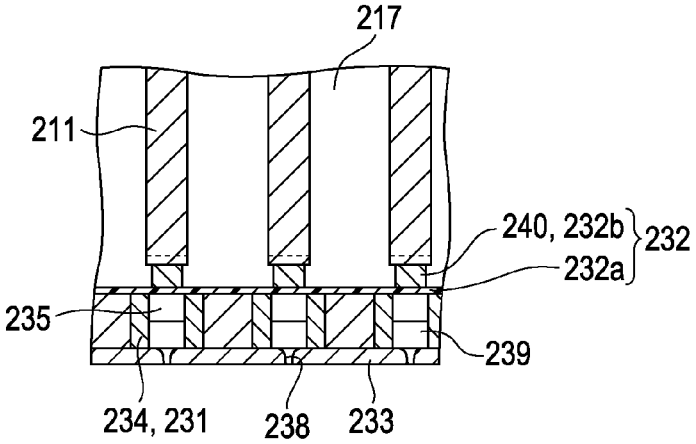

Here, referring to FIGS. 2A and 2B, the head body 20 will be described in further detail. FIGS. 2A and 2B are cross-sectional views illustrating a principal portion of the head body.

As illustrated in FIGS. 2A and 2B, the head body 20 of the embodiment includes a plurality of actuator units 210, a case 250 configured to be capable of accommodating the actuator units 210 in the interior thereof, and a flow channel unit 230 joined to one surface of the case 250.

The actuator units 210 of the embodiment include a piezoelectric actuator forming member 212 having a plurality of piezoelectric actuators 211 arranged in a line in the width direction thereof, and a fixed plate 213. The piezoelectric actuator forming member 212 is joined to the fixed plate 213 in such a manner that a distal end (one end portion) side thereof becomes a free end and a proximal end (other end portion) side thereof is joined as a fixed end.

The piezoelectric actuator forming member 212 includes a piezoelectric material 214, an individual internal electrode 215 configured to constitute internal electrodes which constitute two poles of the piezoelectric actuators 211, that is, individual electrodes electrically independent from the adjacent piezoelectric actuators 211, and a common internal electrode 216 which constitutes a common electrode electrically common to the adjacent piezoelectric actuators 211 laminated alternately.

The piezoelectric actuator forming member 212 is formed with a plurality of slits 217 by, for example, a wire saw or the like, and the distal end side thereof is cut into a comb shape, so that rows of the piezoelectric actuators 211 are formed.

Here, an area of the piezoelectric actuators 211 joined to the fixed plate 213 is an inactive area which does not contribute to oscillation. When a voltage is applied between the individual internal electrode 215 and the common internal electrode 216 which constitute the piezoelectric actuators 211, only an area on the side of the distal end which is not joined to the fixed plate 213 oscillates. Then, a distal end surface of the piezoelectric actuators 211 is fixed to an island portion 240 of a diaphragm 232 described later via an adhesive agent or the like.

Circuit boards 221 such as COF each having a drive circuit 220 such as a drive IC for driving the piezoelectric actuators 211 mounted thereon are connected to the respective piezoelectric actuators 211 of the actuator units 210.

The flow channel unit 230 includes a flow-channel-formed substrate 231, the diaphragm 232, and a nozzle plate 233.

The flow-channel-formed substrate 231 is formed of a silicon monocrystal substrate, and includes pressure generating chambers 235 divided by a plurality of partitioning walls 234 are arranged in a line in the width direction (short direction) on a front layer portion on one side thereof.

Manifolds 236 configured to supply ink as an example of liquid to the respective pressure generating chambers 235 communicate with one end portion side of each of the pressure generating chambers 235 in the longitudinal direction via ink supply channels 237 as an example of liquid supply channels. Opening sides of the pressure generating chambers 235 of the flow-channel-formed substrate 231 are sealed by the diaphragm 232, and the nozzle plate 233 as an example of nozzle forming members formed with nozzle openings 238 is adhered to the other sides thereof via an adhesive agent or a thermal adhesion film. Nozzle openings 238 and the pressure generating chambers 235 of the nozzle plate 233 communicate with each other via nozzle opening communication holes 239 provide through the flow-channel-formed substrate.

The diaphragm 232 is formed of a composite panel including an elastic film 232*a* as a first member formed of a resilient member such as a resin film, and a supporting plate 232*b* as a second member formed of a metal material or the like for example for supporting the elastic film 232*a*, and the side of the elastic film 232*a* is joined to the flow-channel-formed substrate 231. For example, in the embodiment, the elastic film 232*a* as the first member is formed of a PPS (polyphenylene sulfide) film having a thickness on the order of several micrometers and the supporting panel 232*b* as the second member is formed of a stainless steel plate (SUS) having a thickness on the order of several tens micrometers.

In the areas of the diaphragm 232 facing the respective pressure generating chambers 235, the island portions 240 with which distal end portions of the piezoelectric actuators 211 come into abutment are provided. In other words, thinned portions 241 having a thickness smaller than other areas are formed in areas facing peripheral edge portions of the respective pressure generating chambers 235 of the diaphragm 232, and the island portions 240 are formed inside the thinned portions 241, respectively. The distal end portions of the piezoelectric actuators 211 of the actuator units 210 described above are fixed to the island portions 240 as described above via an adhesive agent or the like.

Compliance portions 242 formed by removing parts of the supporting panel 232*b* by etching in the same manner as the thinned portions 241 and composed substantially only of the resilient film 232*a* are provided in areas of the diaphragm 232 facing the manifolds 236. The compliance portions 242 serve to absorb a pressure change by a deformation of the elastic film 232*a* at the compliance portions 242 upon occurrence of the pressure change in the manifolds 236 and maintain the interiors of the manifolds 236 at an always constant pressure.

In the embodiment, the diaphragm 232 is composed of the elastic film 232*a* and the supporting plate 232*b*, and peripheral portions of the island portions 240 and the compliance portions 242 are formed only of the elastic film 232*a*. However, the invention is not limited thereto, and the island portions 240 and the compliance portions 242 may be formed by using one plate member as the diaphragm and providing the thin portions 241 and 242 having a depressed shape formed by removing parts of the panel member in the thickness direction.

The case 250 is fixed on the diaphragm 232 of the flow-channel-formed substrate 231, and is connected to the flow channel member 30 provided on the side opposite from the diaphragm 232 via the wiring substrate 40, so that ink introducing channels 251 configured to supply ink from liquid storage portions such as ink cartridges or the like to the manifolds 236, not illustrated, are provided.

The case 250 is also provided with a plurality of compartments 252 penetrating in the thickness direction and the actuator units 210 are fixed in the respective compartments 252 in position. In the embodiment, eight of the actuator units 210 are provided, and eight of the compartments 252 are provided so that the respective actuator units 210 are accommodated independently.

The case 250 is provided with compliance spaces 253 having a depressed shape opening to areas facing the compliance portions 242. The compliance portions 242 are held so as to be deformable by the compliance spaces 253.

Furthermore, as illustrated in FIG. 1, the wiring substrate 40 provided with a conductive pad to which wiring of the circuit boards 221 are connected is fixed to a surface of the case 250 opposite form the surface joined to the diaphragm 232. The compartments 252 of the case 250 are substantially closed by the wiring substrate 40. The wiring substrate 40 is formed with slit type openings 41 in areas facing the compartments 252 of the case 250, and the circuit boards 221 are drawn out of the compartments 252 through the openings 41 of the wiring substrate 40 and are electrically connected to the wiring substrate 40 on the side of the wiring substrate 40 opposite from the case 250.

The wiring substrate 40 is provided with insertion portions 42 which allow penetration of projections having flow channels of the flow channel member 30 provided in the interior thereof, and the flow channels of the flow channel member 30 which penetrate through the insertion portions 42 and the ink introducing channels 251 communicate each other.

The head body 20 as described above is configured to change the capacities of the respective pressure generating chambers 235 by deformation of the piezoelectric actuators 211 and the diaphragm 232 when ejecting ink droplets and cause ink droplets to be ejected from the predetermined nozzle openings 238. Specifically, when ink is supplied to the manifolds 236 via the ink introducing channel 251 provided in the case 250 from an ink cartridge, not illustrated, ink is distributed to the respective pressure generating chambers 235 via the ink supply channels 237. Actually, the piezoelectric actuators 211 are contracted by applying a voltage to the piezoelectric actuators 211. Accordingly, the diaphragm 232 is deformed together with the piezoelectric actuators 211, the capacities of the pressure generating chambers 235 are increased, and ink is drawn into the pressure generating chambers 235. After the ink has been filled up to the nozzle openings 238, the voltages applied to the electrodes 215 and 216 of the piezoelectric actuators 211 are cancelled according to a recording signal supplied via the circuit board 221. Accordingly, the piezoelectric actuators 211 are expanded and restored to the original state thereof, and the diaphragm 232 is also displaced and restored to the original state thereof. Consequently, the capacities of the pressure generating chambers 235 are reduced, and hence the pressures in the pressure generating chambers 235 are increased, so that ink droplets are ejected from the nozzle openings 238.

Figure 3:
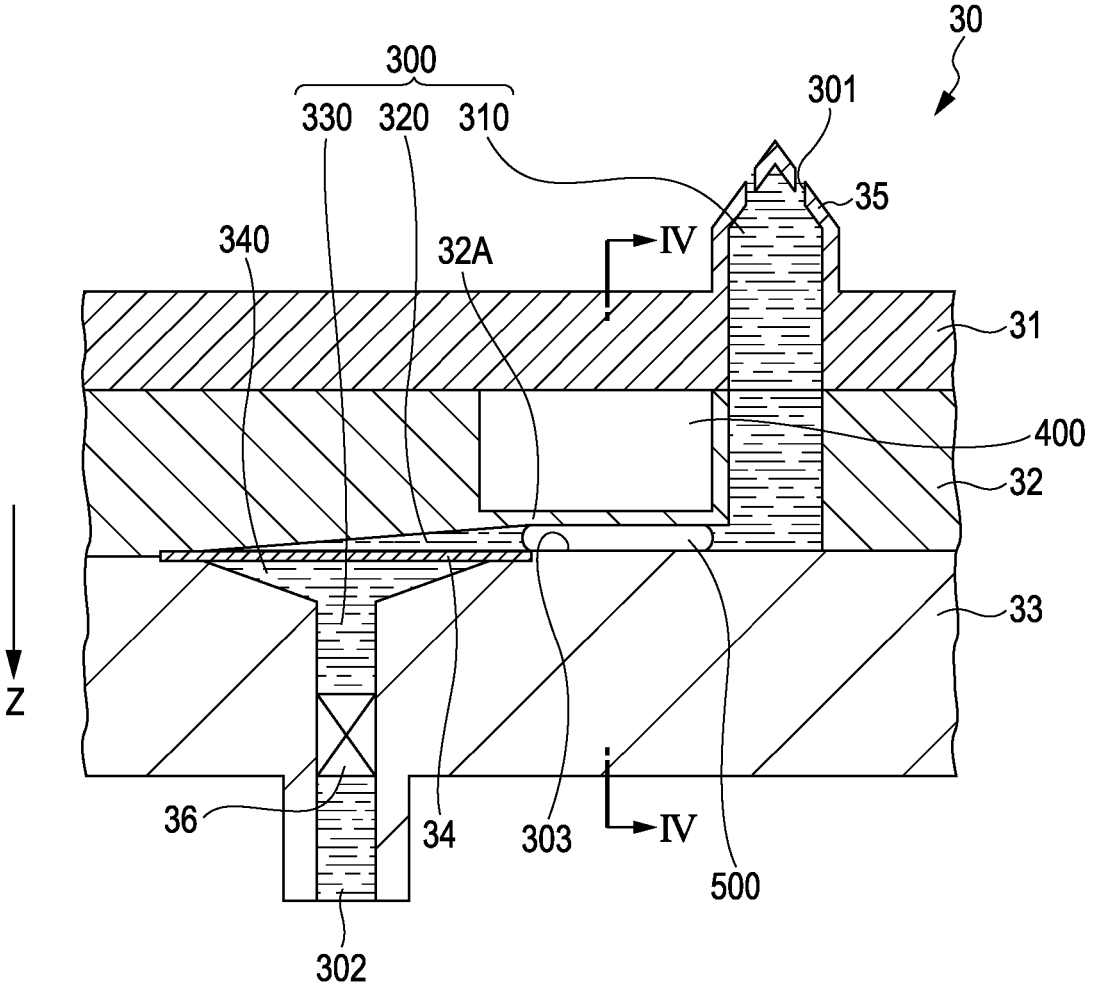
FIG. 3 is a cross-sectional view of a flow channel member according to the embodiment of the invention.
Figure 4:
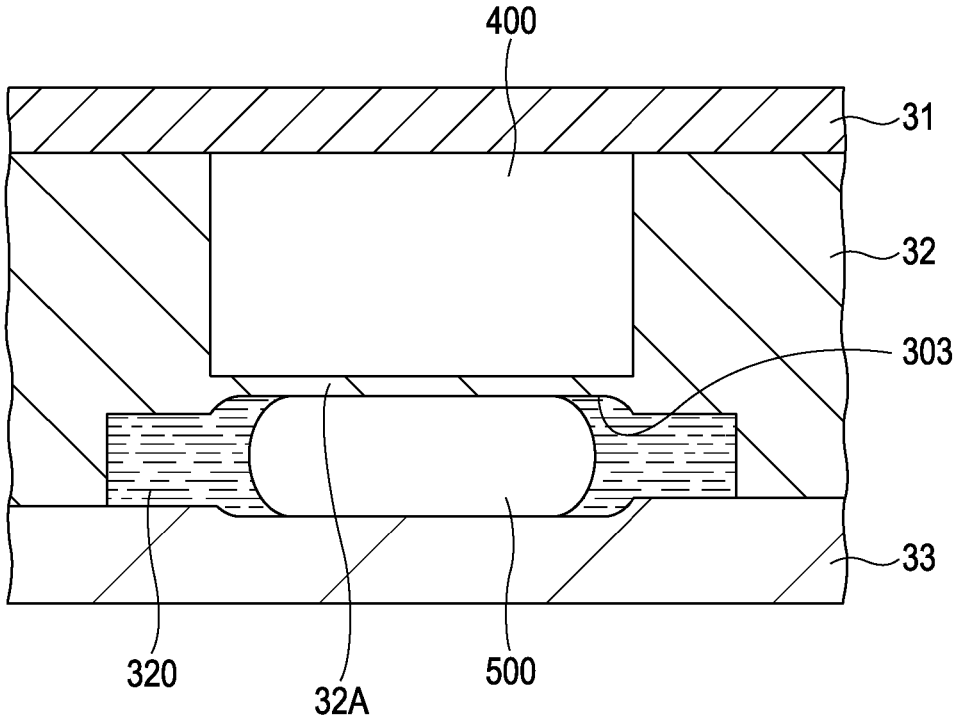
FIG. 4 is a cross-sectional view of a principal portion illustrating a cross section taken along the line IV-IV in FIG. 3.

In contrast, the flow channel member 30 is fixed to the case 250 of the head body 20 with the wiring substrate 40 interposed therebetween. Referring now to FIG. 3 and FIG. 4, the flow channel member 30 will be described further in detail. FIG. 3 is a cross-sectional view illustrating the flow channel member of the embodiment, and FIG. 4 is a cross-sectional view of a principal portion illustrating a cross section taken along the line IV-IV in FIG. 3 illustrated in an enlarged scale.

The illustrated flow channel member 30 is formed by laminating a first flow channel member 31, a second flow channel member 32, and a third flow channel member 33 in a vertical direction Z, and includes ink flow channels 300 which allows ink to flow from inlet ports 301 on the side of the ink cartridge (not illustrated in FIG. 3 and FIG. 4) as an ink supply source toward outlet ports 302 on the side of the head body 20. Each of the ink flow channels 300 includes a first vertical flow channel 310 formed in the interior of a needle portion 35 for mounting the ink cartridge extending from the inlet ports 301 downward in the vertical direction, a horizontal flow channel 320 communicating at one end thereof to a lower end of the first vertical flow channel 310 and extending in the horizontal direction, and a second vertical flow channel 330 communicating with the other end of the horizontal flow channel 320, extending downward in the vertical direction, and communicating with the head body 20 via the outlet port 302. The horizontal flow channel 320 is a horizontal portion formed in the ink flow channel 300, and an air bubble trap 303 is formed in the middle thereof. The air bubble trap 303 has dimensions adjusted in aspect ratio between the width in the horizontal direction and the height in the vertical direction so as to make an air bubble 500 trapped therein into a flat shape. Here, even though the air bubble 500 is trapped by the air bubble trap 303, the ink flows desirably through both sides of the air bubble 500 in the horizontal direction in the horizontal flow channel 320. The he air bubble trap 303 in such a configuration will be described further in detail later.

A filter 34 is disposed horizontally so as to traverse the second vertical flow channel 330 between the other end of the horizontal flow channel 320 and the upper end of the second vertical flow channel 330. In other words, the filter 34 is provided on the downstream of the air bubble trap 303 so as to trap foreign substances or the like in the ink flow channel 300, and a filter chamber 340 as part of the second vertical flow channel 330 is formed immediately below the filter 34. In the second vertical flow channel 330, a self-sealing valve 36 is disposed between the filter 34 and the outlet port 302. The self-sealing valve 36 is opened when the ink is ejected from the head body 20 and hence the downstream side becomes a negative pressure to supply the ink to the head body 20 and, in contrast, the ink flow channel 300 is closed in the normal state (when the ink is not ejected). Here, a pressurizing force is applied to the ink in the ink flow channel 300 from the side of the inlet port 301 by a pressurizing unit, not illustrated, on a steady basis. Therefore, the ink reaching from the inlet port 301 to the self-sealing valve 36 is pressurized by a predetermined pressurizing force and hence is usually in a positive pressure. The air bubble 500 trapped by the air bubble trap 303 by the pressurizing force at this time transmits to the outside via the second flow channel member 32 and the third flow channel member 33.

Furthermore, the second flow channel member 32 of the embodiment is formed of a gas permeable material which allows permeation of the air bubbles therethrough, is configured to allow permeation of the air bubble 500 in the air bubble trap 303 therethrough to the outside further easily. In this case, it does not necessarily have to form the entire part of the second flow channel member 32 with the gas-permeable material. At least, forming a portion facing the air bubble trap 303 and corresponding to the ceiling thereof with an air-bubble permeable wall 32A formed of an air-bubble permeable member which allows permeation of the air bubble 500 therethrough are needed. However, as in the embodiment in which integral molding is employed, a manufacturing process or the like is simplified by integrally molding the air-bubble permeable wall 32A including the gas permeable wall as a matter of course.

Here, the third flow channel member 33 may be formed of a gas-permeable material or at least a part of the third flow channel member 33 facing the air bubble trap 303 and corresponding to the bottom portion thereof may be formed of the air-babble permeable material. In this case, the third flow channel member 33 also allows easy permeation of the air bubble 500 to the outside therethrough. As the air-bubble permeable material, POM (polyacetal), PP (polypropylene), and PPE (polyphenylene ether) are preferable.

An air bubble discharge chamber 400 is a space formed so as to face the air-bubble permeable wall 32A in the second flow channel member 32, and is opened to the atmosphere via a flow channel or the like, not illustrated. Since the ink in the ink flow channel 300 including the air bubble trap 303 is pressurized by a pressurizing unit, the air bubble discharge chamber 400 is in a negative pressure with respect to the interior of the ink flow channel 300. Consequently, permeation of the air bubble 500 trapped in the air bubble trap 303 to the air bubble discharge chamber 400 is achieved via the air-bubble permeable wall 32A and growth of the air bubble 500 is restrained. In this embodiment, since the air bubble trap 303 has a shape which causes the air bubble 500 in abutment with the air-bubble permeable wall 32A to be a flat shape and is pressed by the air-bubble permeable wall 32A, the contact surface area between the air bubble 500 and the air-bubble permeable wall 32A may be increased. Consequently, permeation and discharge of the air bubble 500 in the air bubble trap 303 to the air bubble discharge chamber 400 via the air-bubble permeable wall 32A are achieved further desirably. Therefore, the growing of the air bubble 500 in the air bubble trap 303 is further restrained correspondingly, and hence an interval of cleaning, which is air-bubble maintenance, is elongated, and wasteful consumption of liquid in association with the cleaning may be reduced as much as possible.

Other Embodiments

Although the embodiment of the invention has been described, the basic configuration of the invention is not limited to those described above. For example, provision of the air bubble discharge chamber 400 opened to the atmosphere, which is the space adjacent to the air-bubble permeable wall 32A in the above-described embodiment is not necessarily required. However, since a buffer space for allowing permeation of the air bubble 500 through the air-bubble permeable wall 32A may be provided with the provision of the air bubble discharge chamber 400, an effect of facilitating the permeation and discharge of the air bubble 500 is achieved.

Also, although the horizontal flow channel 320 having the air bubble trap 303 between the first vertical flow channel 310 and the second vertical flow channel 330 is formed in the embodiment described above, the invention is not limited to such a configuration. Only at least part of the ink flow channel 300 needs to be a horizontal flow channel. For example, a configuration in which ink flowing therein from vertically below flows once in the horizontal direction, and then flows out vertically downward is also applicable. In this case, the air bubble trap is formed in the ceiling portion of the horizontal flow channel. The position of the air bubble trap needs not to be specifically limited as long as it is provided on the upstream side of the valve (self-sealing valve 36) and the filter 34, if any. Therefore, the air bubble trap may be disposed right above the filter 34 illustrated in FIG. 3.

Although a pressure generating unit configured to cause a pressure change in the pressure generating chamber 235 has been described using the piezoelectric actuators 211 of a longitudinal oscillation type which includes the piezoelectric material 214, the electrodes 215 and 216 laminated alternately and caused to be expanded and contracted in the axial direction in the embodiment described above, the invention is not specifically limited thereto. For example, piezoelectric actuators of a flexural oscillation type such as a thin film type having electrodes and piezoelectric materials laminated by film formation or Lithography method, and that of a thick film type formed by a method such as bonding a green sheet may also be used. Also, as the pressure generating unit, a configuration in which a heat-generating element is arranged in the pressure generating chamber and liquid droplets are ejected from the nozzle openings by bubbles generated by heat generated by the heat-generating element, or so-called an electrostatic actuator configured to generate static electricity between the diaphragm and the electrode and cause the liquid droplets to be ejected from the nozzle openings by deforming the diaphragm by the electrostatic force may also be used.

Figure 5:
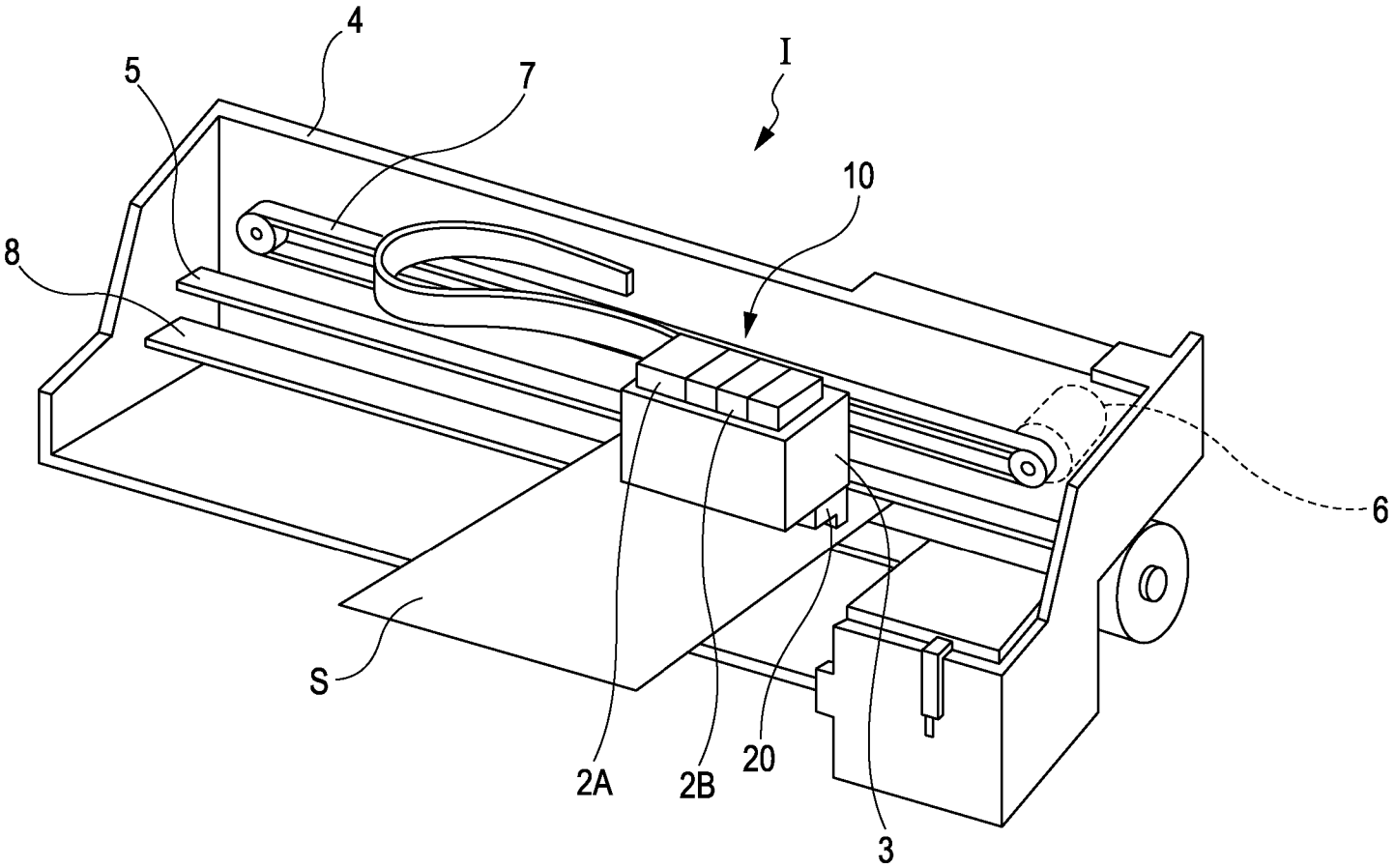
FIG. 5 is a schematic view of a recording apparatus according to the embodiment of the invention.

The ink jet recording heads 10 in the respective embodiments described above constitute part of an ink jet recording head unit having ink flow channels which are in communication with ink cartridges or the like and is mounted on an ink jet recording apparatus. FIG. 5 is a schematic drawing illustrating an example of the ink jet recording apparatus.

In an ink jet recording apparatus I illustrated in FIG. 5, an ink jet recording head unit 1 (hereinafter, also referred to as a head unit 1) having a plurality of the ink jet recording heads 10 includes cartridges 2A and 2B which constitute ink supply units demountably mounted thereon, and a carriage 3 having the head unit 1 mounted thereon is provided on a carriage shaft 5 attached to an apparatus body 4 so as to be movable in the axial direction. The recording head unit 1 is, for example, configured to eject black ink composition and color ink composition, respectively.

Then, by a drive force from a drive motor 6 transmitted to the carriage 3 via a plurality of gears, not illustrated, and a timing belt 7, the carriage 3 having the head unit 1 mounted thereon is moved along the carriage shaft 5. In contrast, a platen 8 is provided on the apparatus body 4 along the carriage shaft 5, and a recording sheet S as a recording medium such as paper supplied by a paper feed roller or the like, not illustrated, is wound around the platen 8 and is transported.

As the ink jet recording apparatus I described above, the one in which the ink jet recording head 10 (the head unit 1) is mounted on the carriage 3 and moves in a primary scanning direction is exemplified. However, the invention is not limited thereto and, for example, the invention may also be applied to a so-called line type recording apparatus in which the ink jet recording head 10 is fixed and performs a printing job only by moving the recording sheet S such as the paper in a secondary scanning direction.

In the example described above, the ink jet recording head 10 provided with the flow channel member 30 has been described. However, the invention may be applied also to the ink jet recording apparatus provided with the flow channel member 30 at a portion other than the ink jet recording head 10. More specifically, in the case of an ink jet recording apparatus in which a storage unit containing ink stored therein is not mounted on the carriage 3, but is fixed to the apparatus body 4, and the ink tank and the head body 20 are connected by a tube-type supply pipe, for example, the flow channel member 30 described above may also be provided in a place where the ink tank is disposed.

In the embodiments described above, the ink jet recording head is exemplified as an example of a liquid ejecting head and the ink jet recording apparatus is exemplified as an example of a liquid ejecting apparatus. However, the invention is intended widely and generally for the liquid ejecting heads and the liquid ejecting apparatuses, and may be applied also to the liquid ejecting heads and the liquid ejecting apparatuses configured to eject liquids other than ink. As other types of liquid ejecting heads, for example, the invention may be applied to a variety of recording heads used for an image recording apparatus such as printers, a coloring material ejecting head used for manufacturing color filters such as liquid crystal displays, an electrode material ejecting head used for forming electrodes for displays such as organic EL displays or FED (field emission displays), and biological organic substance ejecting heads used for manufacturing biological chips, the invention may also be applied to liquid ejecting apparatuses having such liquid ejecting heads.

The invention may be applied not only to flow channel members to be mounted on the liquid ejecting head and the liquid ejecting apparatus, but to flow channel members to be mounted on other devices.

What is claimed is:

1. A flow channel member comprising:

a liquid flow channel having in at least part thereof a horizontal flow channel configured to cause liquid supplied from a liquid supply source in the horizontal direction;

a valve disposed in the liquid flow channel and configured to open and close the liquid flow channel;

a pressurizing unit configured to apply a pressurizing force to the liquid in the liquid flow channel; and an air bubble trap provided in a middle portion of the horizontal flow channel for storing an air bubble, wherein the air bubble trap has a vertical dimension that is less than a horizontal dimension, and includes a substantially flat air-bubble permeable wall formed of an air-bubble permeable member configured to allow permeation of the air bubble therethrough in at least a ceiling portion of the air bubble trap and a substantially flat wall in a bottom portion of the air bubble trap to cause the air bubble entering the air bubble trap to be partially flattened and to be pressed against the air-bubble permeable wall so as to bring the air bubble into surface contact with the air-bubble permeable wall, wherein the horizontal flow path has an upper portion extending from the ceiling portion on a downstream side of the air bubble trap and tapering downward in a downstream direction.

2. The flow channel member according to claim 1, comprising a filter disposed between the air bubble trap and the valve so as to traverse the liquid flow channel.

3. The flow channel member according to claim 1, comprising an air bubble discharge chamber as a space adjacent to the air-bubble permeable wall, wherein the air bubble discharge chamber is configured so as to be capable of opening to the atmosphere.

4. The flow channel member according to claim 1, wherein the air-bubble permeable wall is formed with depressions and projections on a surface on the side of the air bubble trap.

5. A liquid ejecting head comprising:

a head body having a nozzle opening configured to eject liquid; and the flow channel member as recited in claim 1, wherein the liquid flow channel of the flow channel member communicates with the nozzle opening.

6. A liquid ejecting head comprising:

a head body having a nozzle opening configured to eject liquid; and the flow channel member as recited in claim 2, wherein the liquid flow channel of the flow channel member communicates with the nozzle opening.

7. A liquid ejecting head comprising:

a head body having a nozzle opening configured to eject liquid; and the flow channel member as recited in claim 3, wherein the liquid flow channel of the flow channel member communicates with the nozzle opening.

8. A liquid ejecting head comprising:

a head body having a nozzle opening configured to eject liquid; and the flow channel member as recited in claim 4, wherein the liquid flow channel of the flow channel member communicates with the nozzle opening.

9. A liquid ejecting apparatus comprising the liquid ejecting head according to claim 5.

10. A liquid ejecting apparatus comprising the liquid ejecting head according to claim 6.

11. A liquid ejecting apparatus comprising the liquid ejecting head according to claim 7.

12. A liquid ejecting apparatus comprising the liquid ejecting head according to claim 8.

* * * * *